United States Patent [19]

Johanson

[11] Patent Number: 4,795,266

[45] Date of Patent: Jan. 3, 1989

[54] SOLIDS BLENDER WITH CYLINDRICAL INSERTS

[75] Inventor: Jerry R. Johanson, San Luis Obispo, Calif.

[73] Assignee: J R Johanson, Inc., San Luis Obispo, Calif.

[21] Appl. No.: 878,051

[22] Filed: Jun. 24, 1986

[51] Int. Cl.[4] ..... B01F 13/00

[52] U.S. Cl. ..... 366/341; 222/564

[58] Field of Search ..... 366/341, 9, 336, 340, 366/348, 349, 338, 339, 136, 137, 270, 262; 222/459, 564, 547

[56] References Cited

U.S. PATENT DOCUMENTS

| | | | |
|---|---|---|---|
| 2,085,132 | 6/1937 | Underwood | 366/340 |
| 2,486,200 | 10/1949 | Connor | 366/336 |
| 3,092,678 | 6/1963 | Braun | 366/270 |
| 3,378,236 | 4/1968 | Kasai | 366/270 |
| 3,618,901 | 11/1971 | Sindgren | 366/340 |
| 4,286,883 | 9/1981 | Johanson | 366/341 |
| 4,478,517 | 10/1984 | Hoppe | 366/341 |

*Primary Examiner*—Robert W. Jenkins

*Attorney, Agent, or Firm*—Daniel C. McKown

[57] ABSTRACT

A series of hollow cylinders are mounted inside the cylindrical portion of a solids blender to propagate the velocity profile from the bottom to the top of the cylinder and thus to extend the blending capacity of the bin to its entire length and volume. The invention can be used with funnel flow hoppers, mass flow hopper, and cone-in-cone mass flow hoppers. Ranges of the design parameters are described.

3 Claims, 2 Drawing Sheets

SOLIDS BLENDER WITH CYLINDRICAL INSERTS

BACKGROUND OF THE INVENTION

Field of the Invention

This application is in the field of solids flow and processing and more specifically relates to an improvement for use in solids blenders. Typically, such a blender includes a cone-shaped hopper from which a cylindrical bin extends upwardly. Typically, a feeder valve and a conveyor are located at the bottom of the hopper.

Graular solids flowing in a cylindrical column have a natural tendency to produce a uniform velocity in the upper reaches of the cylindrical column even when a large velocity gradient is imposed at the bottom of the cylindrical column by a hopper.

This tendency for a uniform velocity profile is greater when the effective angle of internal friction is small (less than 35°).

For a successful gravity flow blender, one wants to produce a smooth non-uniform velocity profile and to propagate this gradient throughout the blender. Since the natural tendency of flowing solids is to form uniform velocity profiles in cylindrical bins, the useful height of these bins is generally limited to one or two bin diameters of height in the cylinder.

Some improvement may be obtained by using a cone-in-cone hopper blender of the type described in U.S. Pat. No. 4,286,883 of the present inventor. But even this type of apparatus may not propagate a significantly non-uniform velocity profile more than about one diameter vertically.

The present invention allows the useful height of these cylindrical bins to extend upward to several bin diameters by propagating the desirable velocity profile throughout the entire length of the cylinder.

SUMMARY OF THE INVENTION

The present invention involves putting additional components in the bin to propagate the velocity profile from the bottom to the top of the cylindrical bin, regardless of the hopper configuration, so as to extend the blending capability of the bin to its entire length and volume.

In the preferred embodiment of the invention, the inserts have the form of hollow cylinders mounted within the bin and coaxial with it; the height of the cylinders, the spacing between them, and the position of the lowest cylinder with respect to the hopper are all prescribed within limits in accordance with the preferred embodiment.

These variables will be described in greater detail below in connection with the drawings. It is to be expressly understood that the drawings are for the purpose of illustration and description only and are not intended to limit the scope of the invention.

DETAILED DESCRIPTION OF THE PREFERRED EMBODIMENT

Figure 1A:
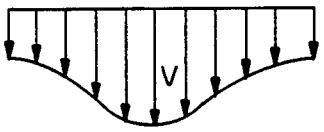
FIG. 1*a* is a graph showing the velocity profile across the bin at its top.
Figure 1:
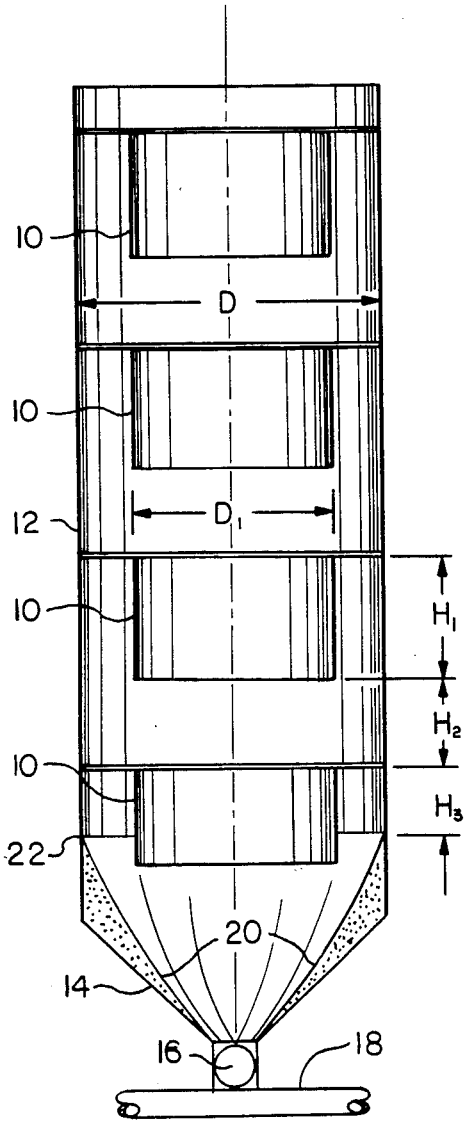
FIG. 1 is a diagram showing a blending bin having a funnel flow hopper.

Turning now to the drawings in which like parts are denoted by the same reference numeral throughout, there is shown in FIG. 1 a solids blender in accordance with a preferred embodiment of the present invention. The blender is a hollow bin for containing a solid state particulate matter. The bin includes a cylindrical wall 12 that extends vertically upward from and is coaxial with a conical hopper 14. A feeder valve 16 is provided at the bottom of the hopper for adjusting the rate of flow of the particulate matter into the conveyor 18, which consists of a hollow duct in which a flow of air is maintained.

In the configuration shown in FIG. 1, the hopper 14 is of the funnel flow type in which a layer of material adjacent the wall of the hopper 14 is not moving during discharge. That layer is shown in FIG. 1 as being the material lying between the dashed lines 20 and the wall of the bin 14. As shown, the material adjacent the wall does flow for elevations above a certain height, 22.

In accordance with the present invention, a series of hollow cylinders 10 are mounted inside of the bin, coaxially with the cylindrical wall 12 and the conical hopper 14.

The height of each cylinder 10 is denoted by $H_1$, and the spacing between adjacent cylinders is denoted by $H_2$. The lowest cylinder must extend above the height 22 by a vertical distance $H_3$.

In the interest of economy, one would like to minimize $H_1$, to maximize $H_2$, and to minimize $H_3$. Also, minimizing $H_1$ and maximizing $H_2$ results in greater crossflow between the inside channel and the outside annular channel, thereby producing a more uniform velocity gradient across the diameter of the bin. This uniform velocity gradient is preferable to a step velocity for purposes of blending.

However, there are limits to how far the minimizing and maximizing can be carried. In general, the minimum usable value of $H_1$, the maximum usable value of $H_2$, and the minimum usable value of $H_3$ are all related to $\delta$, the effective angle of internal friction. $H_1$ has to be large enough to prevent the outward expansion of the central high velocity part of the velocity profile. $H_2$ must be small enough to prevent this advantage from being lost between the cylinders.

By way of example, for $\delta$ equal 35 degrees, $H_1 \min \geqq D/4$ $H_2 \max \leqq D/2$ $H_3 \min \geqq D/8$, where D is the inside diameter of the cylinder wall 12.

The diameter $D_1$ of the cylinder 10 should lie between 0.5D and 0.7D. In the preferred embodiment, the top of the uppermost cylinder should be within a distance $H_2$ of the top of the bin.

FIG. 1*a* is a diagram showing the velocity profile at the top of the bin. It is seen that the non-uniform velocity distribution has been propagated from the bottom of the bin to its top, thereby promoting blending.

Figure 2:
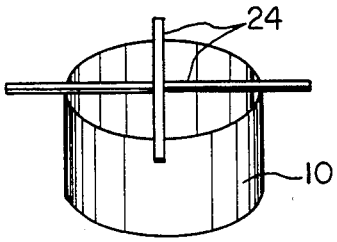
FIG. 2 is a diagram showing in perspective a typical cylinder of the type used in the present invention.

FIG. 2 is a perspective diagram showing a typical one of the cylinders 10. The cylinders 10 are supported within the cylindrical portion of the bin by means of the spider 24.

Figure 3:
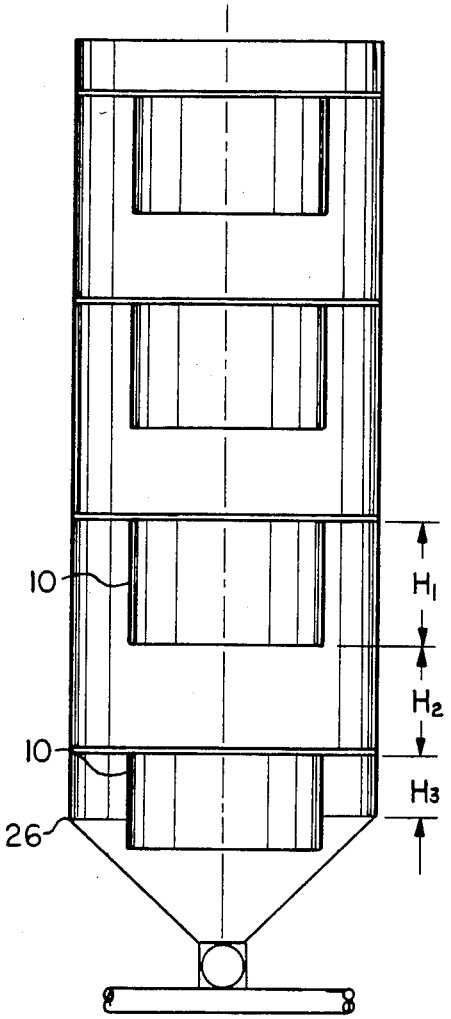
FIG. 3 is a diagram showing a blending bin having a hopper of the mass flow type.

FIG. 3 shows the invention applied to a mass flow hopper, in which there are no non-moving particles.

The design in this case is quite similar to that of FIG. 1, with the notable exception that the lowest cylinder must extend a distance $H_3$ above the upper end 26 of the conical hopper.

Figure 4:
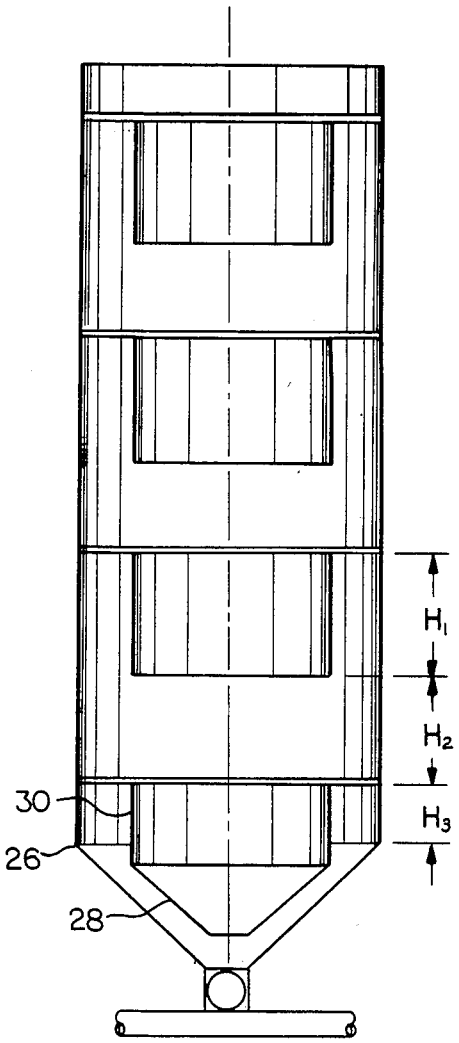
FIG. 4 is a diagram showing a blending bin having a cone-in-cone type of hopper.

FIG. 4 is a diagram showing the cylinders of the present invention installed in a cone-in-cone mass flow hopper. If the cone-in-cone 28 does not protrude above the top 26 of the conical hopper 14, at least a distance D/8, it is necessary either to extend the inner cone 28 further upward or to place a cylinder 30 on the inner cone 28 to extend above the top 26 of the conical hopper. The latter alternative is shown in FIG. 4.

Except for the above-noted restrictions, the remainder of the designs of FIG. 3 and 4 are identical to those of FIG. 1.

Thus, there has been discribed a preferred embodiment of a solids blender that employs cylindrical inserts to propagate the velocity profile from the bottom to the top of the blender thereby extending the blending capacity of the bin to its entire length and volume. It has been shown that the invention is applicable to funnel flow hoppers, mass flow hoppers, and cone-in-cone mass flow hoppers.

The embodiments described above are merely exemplary. Numerous variations should be apparent to those skilled in the art, and those variations are considered to be within the scope of the invention, which scope is limited only by the claims below.

What is claimed is:

1. In a solids blender that includes a hollow conical hopper that opens upwardly into an upwardly extending hollow cylindrical bin coaxial with the hopper, the improvement comprising:

a series of hollow open-ended cylinders located within the solids blender, coaxial with and spaced along the axis of the hollow cylindrical bin, and wherein the uppermost cylinder in said series extends upward to within a distance $H_2$ of the top of the bin, where $H_2$ is also the spacing between the cylinders.

2. In a solids blender that includes a hollow conical funnel flow hopper that opens upwardly into an upwardly extending hollow cylindrical bin coaxial with the hopper, the improvement comprising:

a series of hollow open-ended cylinders located within the solids blender, coaxial with and spaced along the axis of the hollow cylindrical bin, and wherein the top of the lowest cylinder in said series extends a specified distance $H_3$ above the highest point on the bin wall at which a no-flow condition prevails, where $H_3$ is greater than D/8, and where D is the inside diameter of the hollow cylindrical bin.

3. In a solids blender that includes a hollow conical mass flow hopper that opens upwardly into an upwardly extending hollow cylindrical bin coaxial with the hopper, the improvement comprising:

a series of hollow open-ended cylinders located within the solids blender, coaxial with and spaced along the axis of the hollow cylindrical bin, and wherein the top of the lowest cylinder in said series extends a specified distance $H_3$ above the hopper, where $H_3$ is greater than D/8, and where D is the inside diameter of the hollow cylindrical bin.

* * * * *